US007981476B2

(12) United States Patent
Noro et al.

(10) Patent No.: US 7,981,476 B2
(45) Date of Patent: Jul. 19, 2011

(54) APPARATUS FOR COATING OUTER PERIPHERAL SURFACE OF PILLAR STRUCTURE AND METHOD FOR COATING OUTER PERIPHERAL SURFACE OF PILLAR STRUCTURE

(75) Inventors: Takashi Noro, Nagoya (JP); Takahisa Kaneko, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 1115 days.

(21) Appl. No.: 10/531,577

(22) PCT Filed: Oct. 21, 2003

(86) PCT No.: PCT/JP03/13431

§ 371 (c)(1),
(2), (4) Date: Apr. 18, 2005

(87) PCT Pub. No.: WO2004/037441

PCT Pub. Date: May 6, 2004

(65) Prior Publication Data

US 2005/0249877 A1 Nov. 10, 2005

(30) Foreign Application Priority Data

Oct. 22, 2002 (JP) ..... 2002-306708

(51) Int. Cl.
*B05D 1/42* (2006.01)
*B05C 11/02* (2006.01)

(52) U.S. Cl. ..... 427/355; 427/356; 118/107; 118/108; 118/232

(58) Field of Classification Search ..... 427/289, 427/355, 356; 118/107, 109, 232, 108
See application file for complete search history.

(56) References Cited

U.S. PATENT DOCUMENTS 4,728,539 A * 3/1988 Gane ..... 427/356
5,749,970 A 5/1998 Fukuta et al.

FOREIGN PATENT DOCUMENTS

| | | |
|---|---|---|
| JP | A-58-210873 | 12/1983 |
| JP | U 59-61879 | 4/1984 |
| JP | A 04-64768 | 2/1992 |
| JP | A 08-323727 | 12/1996 |
| JP | A 2000-056609 | 2/2000 |

* cited by examiner

*Primary Examiner* — Kirsten C Jolley
(74) *Attorney, Agent, or Firm* — Oliff & Berridge, PLC

(57) ABSTRACT

An apparatus for coating the outer peripheral surface 1*a* of a pillar structure 1 comprising a smoothing means 10 having a smoothing plate 10*a* and an elastic body 10*b*; the elastic body 10 being disposed to be contacted with the outer peripheral surface 1*a* of the pillar structure 1 to be coated. The coating surface of a coating material supplied to the outer peripheral surface 1*a* is smoothed between the outer peripheral surface 1*a* and the elastic body 10*b*. A method for coating the outer peripheral surface of a pillar structure is also provided. According to the method by using the apparatus, the occurrence of partial uncoating or peeling of the coating and occurrence of cracks in the coating portion during drying after coating can be inhibited since the coating material can be applied thinly and uniformly on the outer peripheral surface, thereby the coating surface is smoothed.

15 Claims, 6 Drawing Sheets

APPARATUS FOR COATING OUTER PERIPHERAL SURFACE OF PILLAR STRUCTURE AND METHOD FOR COATING OUTER PERIPHERAL SURFACE OF PILLAR STRUCTURE

TECHNICAL FIELD

The present invention relates to an apparatus for coating the outer peripheral surface of a pillar structure and a method for coating the outer peripheral surface of a pillar structure. More particularly, it relates an apparatus for coating the outer peripheral surface of a pillar structure and a method for coating the outer peripheral surface of a pillar structure according to which an outer peripheral surface coating free from defects can be formed by inhibiting occurrence of partial uncoating and peeling of the coating during coating of the outer peripheral surface of a pillar structure and formation of cracks during drying.

BACKGROUND ART

Hitherto, coating of the outer peripheral surface of a pillar structure of which the outer peripheral surface is curved surface, such as cylindrical columnar body or elliptic columnar body, has often been carried out by hand labor, which is not efficient. Thus, the inventors proposed an apparatus for coating the outer peripheral surface of a ceramic honeycomb structure (a pillar structure) (JP-A-4-64768). According to this apparatus, the outer peripheral surface of a ceramic honeycomb structure of which the outer peripheral portions have been previously removed by working is coated with a slurry to form an outer wall part, and thus a product having a sufficient strength can be obtained even from such a honeycomb fired body as having deformed cells on the peripheral part (outer peripheral surface). However, in the case of this apparatus for coating the outer peripheral surface, there are caused omission of coating at both end portions of the outer peripheral surface, difficulty in taking out of the product after coating and contamination of the apparatus with coating materials, resulting in problems in both the quality and the operability.

Furthermore, the inventors proposed an apparatus for coating the outer peripheral surface of a columnar body (pillar structure) (JP-A-8-323727). This apparatus is characterized by being provided with a first pallet holding the columnar body, a mechanism rotating on the central axis of the first pallet and a smoothing plate provided with a given clearance from the outer periphery of the columnar body. According to this apparatus, a coating material is coated on the rotating columnar body disposed on the first pallet by the smoothing plate, and a coated columnar body high in dimensional accuracy can be obtained in a short time as compared with hand-coating. However, in the case of this outer peripheral surface coating apparatus, there are problems when the clearance between the outer peripheral surface of the columnar body and the smoothing plate becomes irregular owing to slanting of the columnar body or the like.

DISCLOSURE OF INVENTION

The above-mentioned conventional apparatuses suffer from the problems that in case the clearance partially becomes too small or the outer periphery of the columnar body contacts with the smoothing plate due to the slanting of the columnar body, partial uncoating or peeling off of the coating is caused. Moreover, when the clearance between the outer periphery of the columnar body and the smoothing plate is made too large so that they do not contact with each other, the coating becomes too thick and hence cracks occur in the coating portion during drying. The present invention has been made in view of the above problems, and the object of the present invention is to provide an apparatus for coating the outer peripheral surface of a pillar structure and a method for coating the outer peripheral surface of a pillar structure according to which occurrence of partial uncoating or peeling of the coating during coating of the outer peripheral surface of a pillar structure and occurrence of cracks during drying after coating are inhibited by thinly and uniformly coating the outer peripheral surface of the pillar structure with a coating material and then smoothing the coating surface, and, as a result, an outer peripheral surface coating free from defects can be formed.

For attaining the above object, the present invention provides the following apparatus for coating the outer peripheral surface of a pillar structure and method for coating the outer peripheral surface of a pillar structure.

[I] An apparatus for coating the outer peripheral surface of a pillar structure which is provided with a holding means which holds the pillar structure in nearly vertical direction and rotates together with the held pillar structure on an axis of nearly vertical direction as a common rotating axis, a supplying and coating means which supplies a coating material to the outer peripheral surface of the rotating pillar structure and coats the coating material on the outer peripheral surface and a plate-like smoothing means the one longer side end portion of which is disposed at a given position with respect to the outer peripheral surface and which smoothes the coating surface of the coating material supplied to and coated on the outer peripheral surface, wherein the smoothing means has a smoothing plate and a sheet-like elastic body provided at the longer side end portion of the smoothing plate on the side of the pillar structure, the elastic body is disposed so that it contacts with the outer peripheral surface of the pillar structure, the coating material is supplied to and coated on the outer peripheral surface through the elastic body, and the coating surface is smoothed between the outer peripheral surface and the elastic body.

[2] An apparatus for coating the outer peripheral surface of a pillar structure described in the above [1], wherein the smoothing means is disposed so that its longer direction nearly coincides with the central axis direction of the pillar structure and the elastic body constituting the smoothing means is disposed so that it contacts with the outer peripheral surface of the pillar structure between both end faces of the pillar structure.

[3] An apparatus for coating the outer peripheral surface of a pillar structure described in the above [1] or [2], wherein the holding means holds the pillar structure placed thereon with one end thereof facing downward and has a pedestal rotating together with the held pillar structure on the axis of the nearly vertical direction as the common rotating axis.

[4] An apparatus for coating the outer peripheral surface of a pillar structure described in the above [3], wherein the holding means has a cam which is disposed on the side of another end of the pillar structure placed and held on the pedestal and rotates on the axis of the nearly vertical direction as the common rotating axis.

[5] An apparatus for coating the outer peripheral surface of a pillar structure described in the above [4], wherein the outer peripheral shape of the pedestal and that of the cam are nearly the same.

[6] An apparatus for coating the outer peripheral surface of a pillar structure described in any of the above [3]-[5] which is further provided with a centering means which holds the pillar structure and the pedestal and/or the cam in a given positional relation.

[7] An apparatus for coating the outer peripheral surface of a pillar structure described in any one of [3]-[6] which is further provided with a following means which drives the smoothing means following the outer periphery of the pedestal and/or the cam so that the smoothing means is disposed at a given position with respect to the outer peripheral surface of the pillar structure.

[8] An apparatus for coating the outer peripheral surface of a pillar structure described in any one of the above [4]-[7], wherein the following means has first and second following rollers which are disposed at a given distance from each other and move backward and forward following the outer periphery of the cam while contacting with the outer periphery of the cam together with the supplying and coating means and the smoothing means, and the first and second following rollers are disposed so that the angle formed by a straight line passing through the centers of the respective rollers and a tip portion of the smoothing means is a given angle.

[9] An apparatus for coating the outer peripheral surface of a pillar structure described in the above [8], wherein the following means further has third and fourth following rollers which move backward and forward following the outer periphery of the pedestal while contacting with the outer periphery of the pedestal together with the supplying and coating means and the smoothing means, and the rotating axis of the third following roller and that of the first following roller are common and the rotating axis of the fourth following roller and that of the second following roller are common.

[10] An apparatus for coating the outer peripheral surface of a pillar structure described in any one of the above [1]-[9], wherein the sheet-like elastic body has a width of 1-10 mm.

[11] An apparatus for coating the outer peripheral surface of a pillar structure described in any one of the above [1]-[10], wherein the sheet-like elastic body has a thickness of 1-5 mm.

[12] An apparatus for coating the outer peripheral surface of a pillar structure described in any one of the above [1]-[11], wherein the sheet-like elastic body has a hardness of 30-80.

[13] An apparatus for coating the outer peripheral surface of a pillar structure described in any one of the above [1]-[12], wherein the elastic body comprises rubber or sponge.

[14] An apparatus for coating the outer peripheral surface of a pillar structure described in any one of the above [3]-[13], wherein the outer periphery of the pedestal and/or the cam comprise stainless steel or ceramics.

[15] An apparatus for coating the outer peripheral surface of a pillar structure described in any one of the above [1]-[14], wherein the smoothing plate comprises stainless steel or ceramics.

[16] An apparatus for coating the outer peripheral surface of a pillar structure described in any one of the above ([1]-[15], wherein the shape of a section of the pillar structure cut along a plane perpendicular to the central axis of the pillar structure is circular or elliptical.

[17] An apparatus for coating the outer peripheral surface of a pillar structure described in any one of the above [1]-[16], wherein the pillar structure is a honeycomb structure comprising a plurality of cells which are flow paths for fluid.

[18] An apparatus for coating the outer peripheral surface of a pillar structure described in any one of the above [1]-[17], wherein the supplying and coating means and the smoothing means can rotate together along the outer periphery of the pillar structure.

[19] A method for coating the outer peripheral surface of a pillar structure using the apparatus for coating the outer peripheral surface of a pillar structure described in any one of the above [1]-[18] which comprises holding the pillar structure by the holding means, supplying the coating material from the supplying and coating means on the outer peripheral surface of the pillar structure and coating the coating material thereon while rotating the pillar structure and the holding means on the axis of nearly vertical direction as a common rotating axis, and smoothing the coating surface of the supplied and coated coating material between the outer peripheral surface and the sheet-like elastic body.

BEST METHOD FOR CARRYING OUT THE INVENTION

Figure 1:
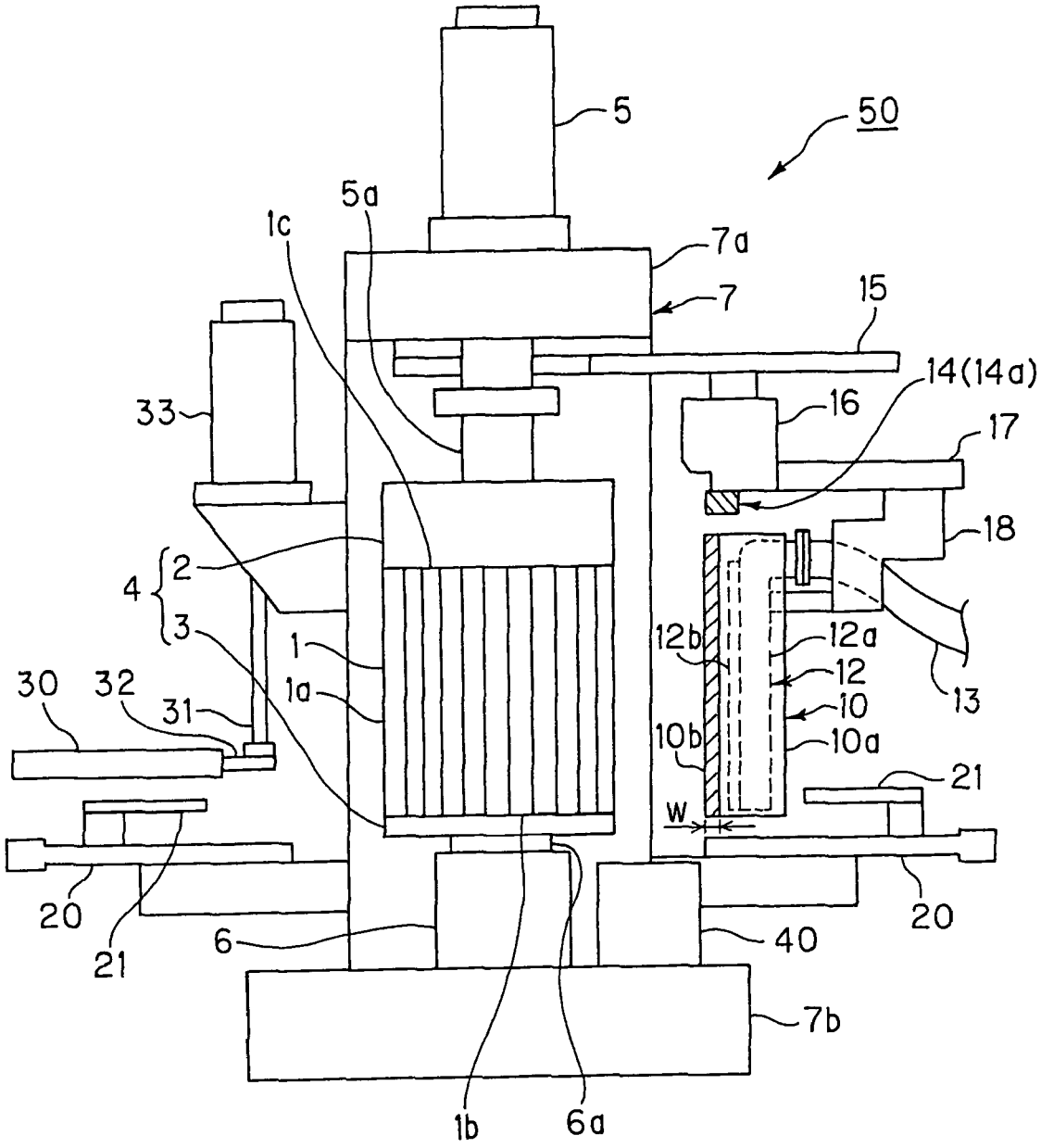
FIG. 1 is a front view which schematically shows one embodiment of the apparatus for coating the outer peripheral surface of a pillar structure according to the present invention.

According to the apparatus for coating the outer peripheral surface of a pillar structure of the present invention, the smoothing means has a smoothing plate and a sheet-like elastic body, the elastic body is disposed in such a manner that it contacts with the outer peripheral surface of the pillar structure, and the coating surface of a coating material supplied to the outer peripheral surface of the pillar structure from the supplying and coating means and coated on the outer peripheral surface is smoothed between the outer peripheral surface and the elastic body, and, therefore, occurrence of partial uncoating or peeling of the coating can be inhibited, and furthermore since the coating material is thinly and uniformly coated, occurrence of cracks in the coating portion during drying after coating can be inhibited. As a result, a coating on the outer peripheral surface free from defects can be formed. When the pillar structure is disposed at a slant, the elastic body can contact with the whole outer peripheral surface of the pillar structure in the axial direction of the columnar body, and hence the coating can also be inhibited from partial uncoating or peeling and cracking during drying after coating. Furthermore, the method for coating the outer peripheral surface of a pillar structure according to the present invention comprises coating a coating material on the outer periphery of the pillar structure and smoothing the coating surface using the apparatus for coating the outer peripheral surface of a pillar structure of the present invention, and hence occurrence of partial uncoating or peeling of the coating can be inhibited, and furthermore since the coating material is thinly and uniformly coated, occurrence of cracks in the coating portion during drying after coating can be inhibited. As a result, a coating on the outer peripheral surface free from defects can be formed.

The embodiments of the present invention will be specifically explained referring to the drawings. It should be understood that the present invention is not limited to the following embodiments, and variations or alterations of designs may be optionally made without departing from the spirit of the present invention.

FIG. 1 is a front view which schematically shows one embodiment of the apparatus for coating the outer peripheral surface of a pillar structure according to the present invention.

As shown in FIG. 1, in the apparatus 50 for coating the outer peripheral surface of a pillar structure according to this embodiment, a holding means 4 comprising a pedestal 3 and a cam 2 is fitted at around the central part of a frame 7 in such a manner that it can rotate on an axis of vertical direction as a rotating axis, and a smoothing means 10 and a supplying and coating means 12 are fitted together to a frame top part 7*a* through a back and forth moving base 15, an arm rotating part 16 and arms 17 and 18.

The pedestal 3 constituting the holding means 4 is in the form of a disc and fitted to a frame bottom part 7*b* in such a manner that it is vertically movable and its central axis is in vertical direction. To the pedestal 3 is fitted a pedestal motor 6 through a shaft 6*a*, and the pedestal 3 rotates on the central axis of the pedestal 3 as a rotation center. Furthermore, the cam 2 constituting the holding means 4 is in the form of a thick disc (a cylindrical body low in height) and fitted to a frame top part 7*a* in such a manner that it is vertically movable and its central axis nearly coincides with the central axis of the pedestal 3. To the cam 2 is fitted a cam motor 5 through a shaft 5*a*, and the cam 2 rotates on the central axis of the cam 2 as a rotation center. The rotation of pedestal 3 and that of cam 2 are synchronous. For holding the pillar structure 1 by the holding means 4 having the above construction, the pillar structure 1 is placed on the pedestal 3 with the central axis nearly coinciding with the central axis of the pedestal 3 (with one end 1*b* facing downwardly), and the cam 2 is disposed on the side of another (upper) end 1*c*, thereby to interpose (hold) the pillar structure 1 between the pedestal 3 and the cam 2. The thus held pillar structure 1 can rotate on the central axis as a common rotating axis (common to the central axis of cam 2 and that of the pedestal 3) simultaneously with synchronous rotation of pedestal 3 and cam 2. Here, the cam 2 and the pedestal 3 are formed so that their outer peripheral shape is nearly the same as that of the pillar structure 1.

Figure 6:
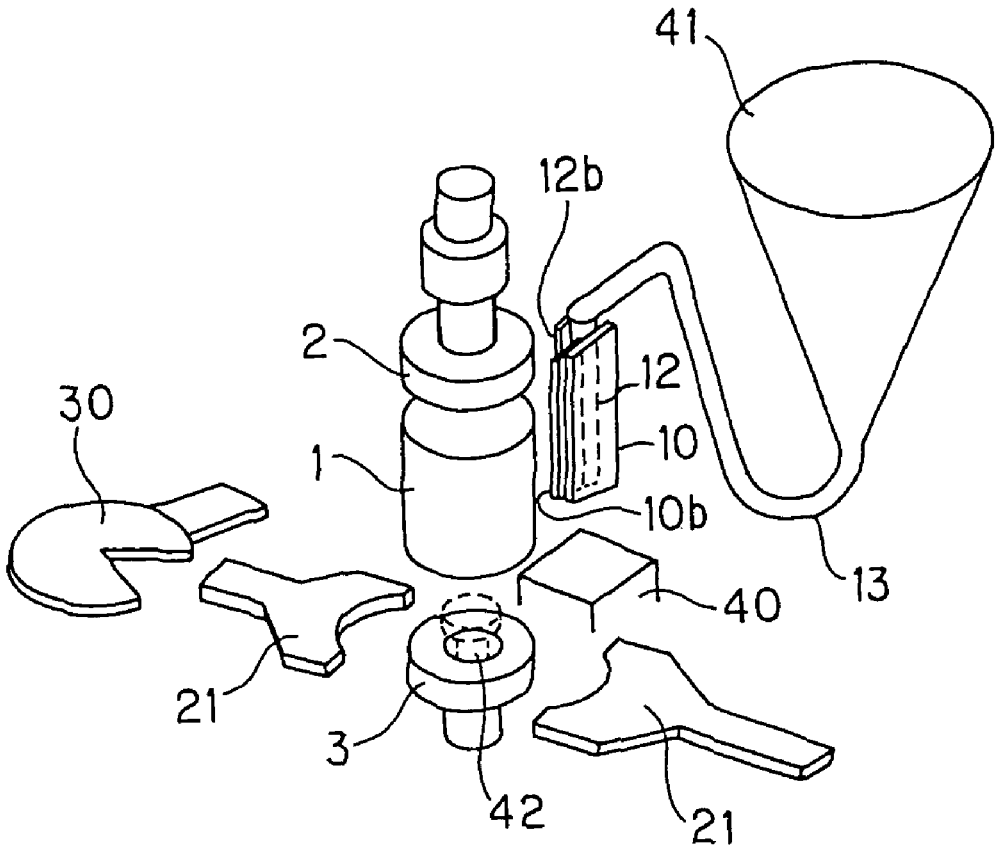
FIG. 6 is an oblique view which schematically shows one embodiment of the apparatus for coating the outer peripheral surface of a pillar structure according to the present invention.

When the pillar structure 1 is to be placed on the pedestal 3, the pillar structure 1 is placed on a transferring pallet 30 shown in FIG. 1 and FIG. 6, and the transferring pallet 30 having the pillar structure 1 placed thereon is moved to the space above the pedestal 3. In this case, the transferring pallet 30 is rotated and moved by a swing motor 33 through a support shaft 31 and swing arm 32. As shown in FIG. 6, an elevatable push-up plate 42 provided at the central portion of the pedestal 3 elevates to place the pillar structure 1 thereon, and after the transferring pallet 30 moves to the original position, the push-up plate 42 lowers and stays on the pedestal 3 (the upper surface of the pedestal 3 and the upper surface of the push-up plate 42 are positioned at the same plane). Thus, the pillar structure 1 is disposed on the pedestal 3, and by the centering plates 21, 21 shown in FIG. 1 and FIG. 6, the pillar structure 1 is positioned so that the central axis thereof nearly coincides with the central axis of cam 2 and that of pedestal 3. As shown in FIG. 1, the two centering plates 21, 21 are disposed on two rails 20, 20 provided on nearly the same straight line. The two centering plates 21, 21 move on the rails 20, 20 to the direction of the central axis of the cam 2 and the pedestal 3 and stop at the positions which are nearly equal in distance between the respective centering plates 21, 21 and the central axis of the cam 2 and that of the pedestal 3 and at the positions at which the distance between the two centering plates 21, 21 is nearly the same as the outer diameter of the pillar structure 1, whereby the central axis of the pillar structure 1 is allowed to nearly coincide with the central axis of the cam 2 and that of the pedestal 3. The portion of the centering plate 21 which contacts with the outer peripheral surface 1*a* preferably has a shape conforming to the shape of the outer peripheral surface 1*a*, and, for example, in the case of cylindrical pillar structure, the portion preferably has a shape conforming to a circular arc as shown in FIG. 6.

The upper end of the pillar structure 1 disposed on the pedestal 3 contacts with the cam 2 when the pedestal 3 is elevated along a pair of guide rails (not shown) and thus the pillar structure 1 is interposed between the cam 2 and the pedestal 3 (the cam 2 is disposed on the side of upper end of the pillar structure 1). Thus, the pillar structure 1 is in the state of being held by the holding means 4. Here, it is preferred to attach a cushioning sheet such as of rubber or sponge to the opposing faces of the pedestal 3 and the cam 2 (faces contacting with the end faces 1*b* and 1*c* of the pillar structure 1) for inhibiting breakage of the pillar structure 1.

In the supplying and coating means 12, a nozzle 12*b* having an opening in the form of a slit is formed at a supplying pipe 12*a* in such a manner that the longer direction of the nozzle 12*b* is along the longer direction of the supplying pipe 12*a*, and a slit-shaped hole is formed at the supplying pipe 12*a* so that the hole communicates with the opening (space portion) of the nozzle 12*b*. A piping 13 is connected to another end (upper end) of the supplying pipe 12*a* for supplying the coating material.

The supplying and coating means 12 is disposed so that the opening of the nozzle 12*b* faces the side of the pillar structure 1 and the central axis of the supplying pipe 12*a* (the longer direction of the nozzle 12*b*) is in the direction of the central axis of the pillar structure 1. The piping 13 is connected to the upper portion of the supplying pipe 12*a*, and the coating material supplied through the piping 13 is supplied to the outer peripheral surface 1*a* of the pillar structure 1 from the opening of the nozzle 12*b* through the supplying pipe 12*a* and coated on the outer peripheral surface.

As shown in FIG. 1, the smoothing means 10 is provided so that its longer direction coincides with the central axis of the pillar structure 1. The smoothing means 10 includes a smoothing plate 10*a* and an elastic body 10*b*, and the smoothing plate 10*a* is a rectangular plate as shown in FIG. 1, and the elastic body 10*b* is a sheet-like elastic body worked into a form of strip and is disposed at the longer side end portion of the smoothing plate 10*a* along the side of the pillar structure 1.

Figure 2:
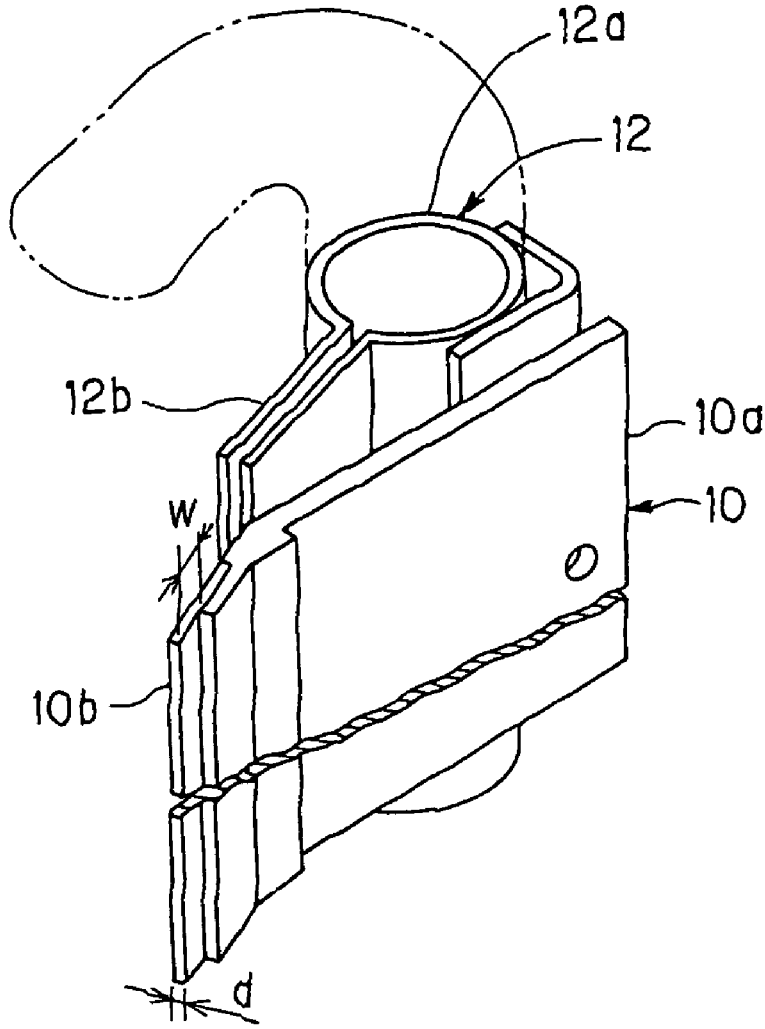
FIG. 2 is an enlarged oblique view which schematically shows a smoothing means and a supplying and coating means used in one embodiment of the apparatus for coating the outer peripheral surface of a pillar structure according to the present invention.

As shown in FIG. 2, the supplying and coating means 12 and the smoothing means 10 are formed integrally in such a manner that the direction of the nozzle 12*b* of the supplying and coating means 12 is the same as the direction of the elastic body 10*b* of the smoothing means 10. The supplying and coating means 12 and the smoothing means 10 which are formed integrally are disposed so that the nozzle 12*b* and the elastic body 10*b* face the side of the pillar structure 1 and are along the outer peripheral surface 1*a*.

As shown in FIG. 1, a nearly cylindrical following roller 14 as a following means is provided at the bottom of arm rotating part 16 and is formed in such a manner that it moves in nearly horizontal direction together with the supplying and coating means 12 and the smoothing means 10 through the arms 17 and 18 and the arm rotating part 16. The horizontal movement is carried out by nearly horizontal slide movement of the back and forth moving base 15 to which the arm rotating part 16 is fitted. The following roller 14 is formed in such a manner that when it contacts with the cam 2, it freely rotates by the force of rotation of the cam 2 while contacting with the cam 2 on the axis of vertical direction as a rotating center.

Figure 3:
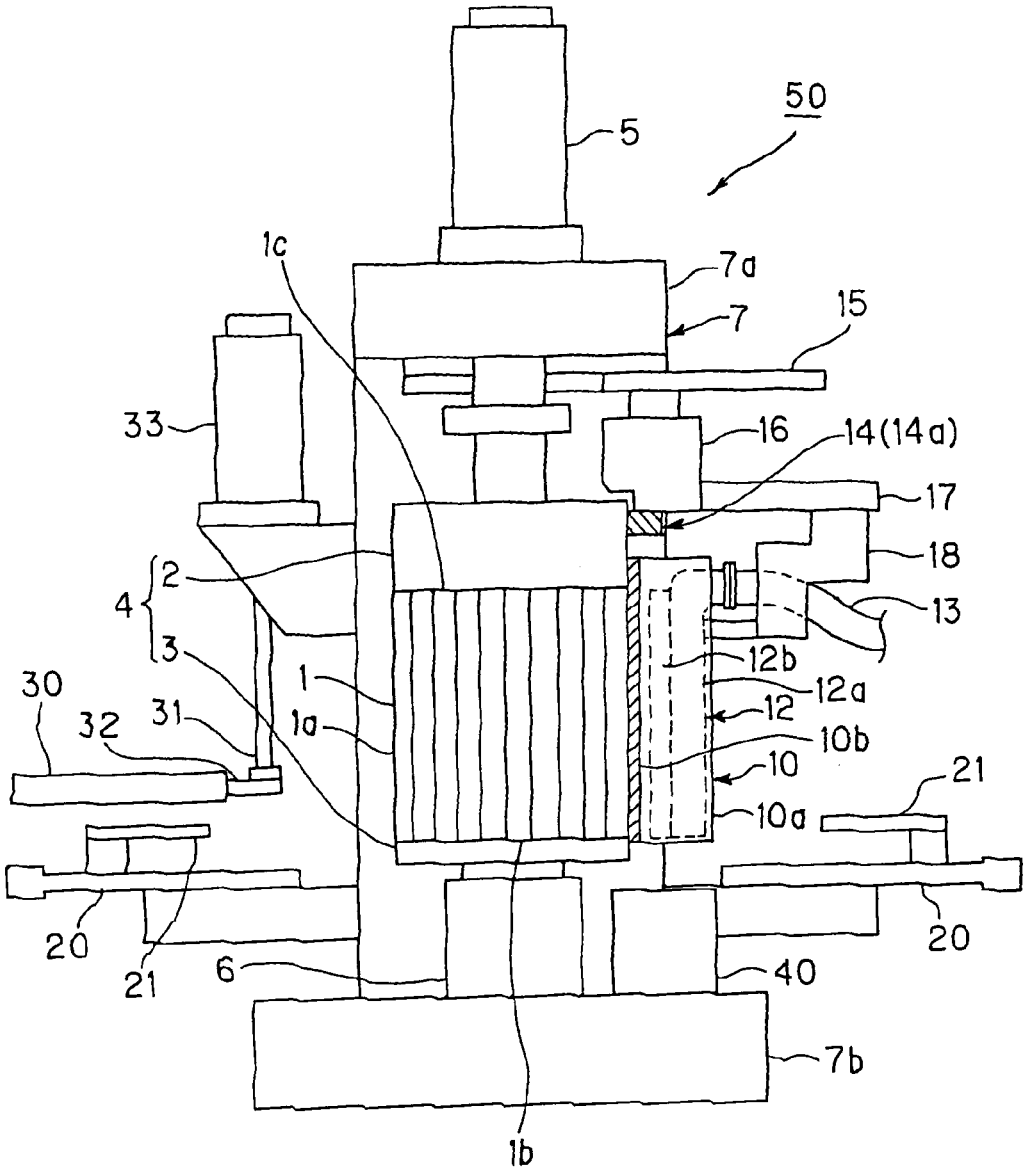
FIG. 3 is a front view which shows one embodiment of the apparatus for coating the outer peripheral surface of a pillar structure according to the present invention and schematically shows a state in which the supplying and coating means and the like are moved to the side of the pillar structure.

FIG. 3 shows the state when the elastic body 10*b* of the smoothing means 10 contacts with the outer peripheral surface 1*a* and the following roller 14 contacts with the outer peripheral surface of the cam 2. This state shows the state of FIG. 1 in which the supplying and coating means 12, the smoothing means 10, the following roller 14 and the back and forth moving base 15 which move together are moved to the side of the pillar structure 1 by the slide movement of the back and force moving base 15 for carrying out the coating of the outer peripheral surface 1*a*. Since this movement is a horizontal movement, the longer direction of the supplying pipe 12*a* (and nozzle 12*b*) of the supplying and coating means 12, the longer direction of the smoothing means 10 (elastic body 10*b*) and the rotating axis of the roller 14 all maintain the state of being nearly parallel with the central axis of the pillar structure 1.

Figure 4:
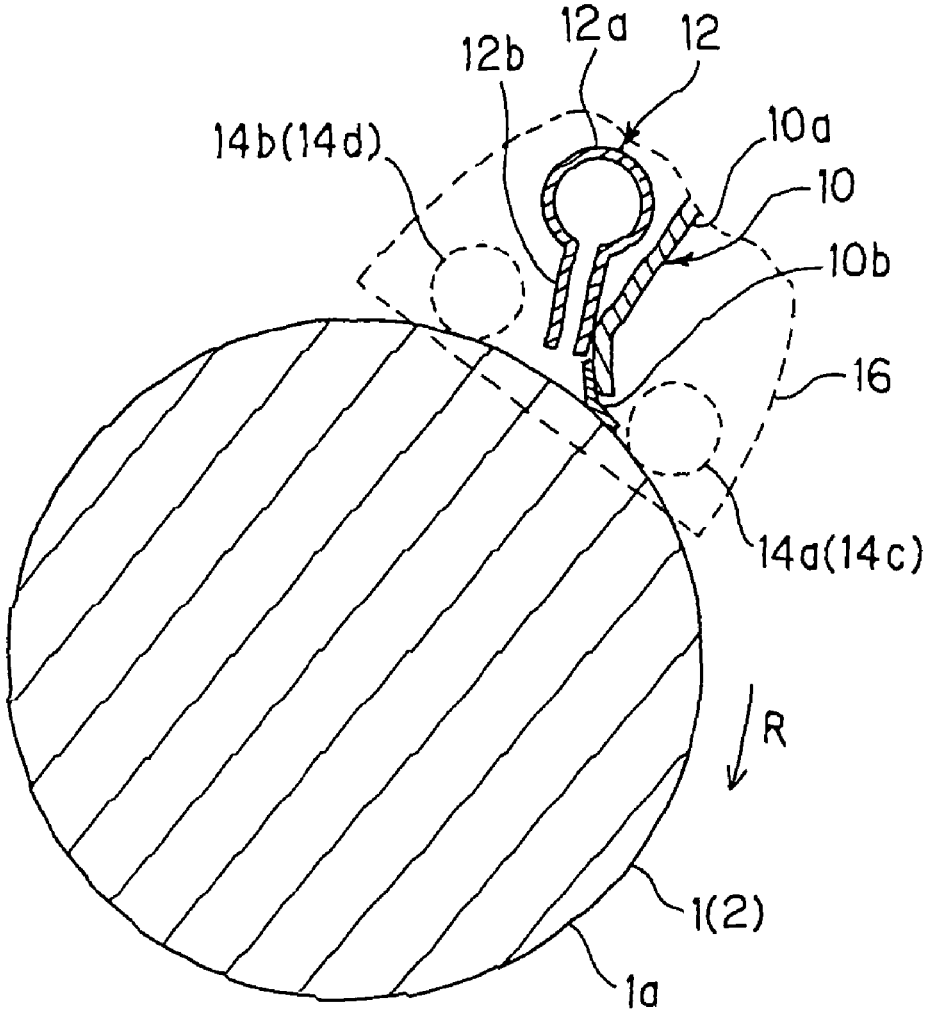
FIG. 4 is a sectional view which shows mutual positional relation of a smoothing means, a supplying and coating means and a following means used in one embodiment of the apparatus for coating the outer peripheral surface of a pillar structure according to the present invention.

As shown in FIG. 3, the elastic body 10*b* constituting the smoothing means 10 is provided so that it contacts with the outer peripheral surface 1*a* of pillar structure 1 between both ends 1*b* and 1*c*, and as shown in FIG. 4, the nozzle 12*b* of supplying and coating means 12 is disposed at a given distance from the outer peripheral surface of pillar structure 1 with the opening of the nozzle 12*b* of supplying and coating means 12 being directed toward the side of pillar structure 1. The coating material supplied through the piping 13 (see FIG. 3) is supplied to the outer peripheral surface 1*a* of the rotating pillar structure 1 from the nozzle 12 and coated thereon, and immediately thereafter the coating surface of the coating material is smoothed between the outer peripheral surface 1*a* and the elastic body 10*b* of smoothing means 10 together with the supplying and coating means 12 (namely, the coating surface is smoothed by the elastic body 10*b*), and thus the outer peripheral surface 1*a* of pillar structure 1 is coated.

As mentioned above, the elastic body 10*b* of the smoothing means 10 is disposed so as to contact with the outer peripheral surface 1*a* of the pillar structure 1, and the coating surface of the coating material supplied to the outer peripheral surface 1*a* of the rotating pillar structure 1 from the nozzle 12 of the supplying and coating means 12 and coated thereon is smoothed between the outer peripheral surface 1*a* and the elastic body 10*b*, and as a result, partial uncoating or peeling of the coating can be inhibited. Furthermore, the elastic body 10*b* smoothes the coating surface of the coating material while contacting with the outer peripheral surface 1*a* of the pillar structure 1 and can thinly and uniformly smooth the outer peripheral surface of the pillar structure 1, and thus the coating portion can be inhibited from cracking at the time of drying after coating. Even when the pillar structure 1 is disposed at a slant, the elastic body 10*b* can contact with the whole outer peripheral surface 1*a* of the pillar structure 1 in the axial direction of the columnar body 1, and hence the coating can also be inhibited from partial uncoating or peeling of the coating. Moreover, since the coating material can be thinly and uniformly coated, the coating portion can be inhibited from cracking at the time of drying after coating.

In this embodiment, as shown in FIG. 4, the following roller 14 used as a following means for moving the supplying and coating means 12 and the smoothing means 10 following the outer peripheral shape of the pillar structure 1 comprises a first following roller 14*a* and a second following roller 14*b*, which are positioned on nearly the same horizontal plane. The two following rollers 14 (the first following roller 14*a* and the second following roller 14*b*) are allowed to move in parallel in a given direction along the outer peripheral shape of the pillar structure 1 upon rotation of the pillar structure 1 while being slightly pressed against the outer peripheral surface of the cam 2 by the force of spring (not shown). When these two following rollers 14 (the first following roller 14*a* and the second following roller 14*b*) move along the outer peripheral shape of the cam 2, since the following rollers 14 move together with the supplying and coating means 12 and the smoothing means 10, the distance between the supplying and coating means 12 and the smoothing means 10 and the outer peripheral surface 1*a* of the pillar structure 1 can be kept constant (with respect to the elastic body 10*b*, the state of contact between the elastic body 10*b* and the outer peripheral surface 1*a* can be kept constant). In this case, it is preferred that the outer diameter of the pillar structure 1 is smaller than the outer diameter of the cam 2 and that of the pedestal 3 by the thickness of the coating to be applied onto the pillar structure 1. By this difference in diameter, the thickness of the coating portion on the outer peripheral surface of the pillar structure can be adjusted. Furthermore, when the sectional shape of the pillar structure 1 cut along a plane perpendicular to the central axis of the pillar structure 1 is circle, the interval between the central axis of the first following roller 14*a* and that of the second following roller 14*b* is preferably 10-170% of a radius of the circle, and when the sectional shape is other than circle, which is "a shape (such as ellipse) having a perimeter of smooth curve (which may include a straight line)", the interval is preferably 10-170% of the smallest radius of curvature. If the interval is less than 10%, since the movement of the following rollers 14 is not stable, the direction (angle) of the supplying and coating means 12 and the smoothing means 10 to the outer peripheral surface 1*a* changes, and, hence, stable coating is sometimes hindered. If it is more than 170%, since the following means 14 is remote from the supplying and coating means 12 and the smoothing means 10, unevenness of the portion of the outer peripheral surface 1*a* with which the following means 14 contacts sometimes differs from that of the portion of the outer peripheral surface 1*a* with which the smoothing means 10 contacts.

In order to move the supplying and coating means 12 and the smoothing means 10 more stably by the following rollers 14, a third following roller 14*c* and a fourth following roller 14*d* which move together with the first following roller 14*a* and the second following roller 14*b* may be provided in such a manner as following the outer peripheral surface of the pedestal 3. In this case, it is preferred for stable moving that the rotating axis of the third following roller 14*c* and that of the first following roller 14*a* are common and the rotating axis of the fourth following roller 14*d* and that of the second following roller 14*b* are common.

Figure 5:
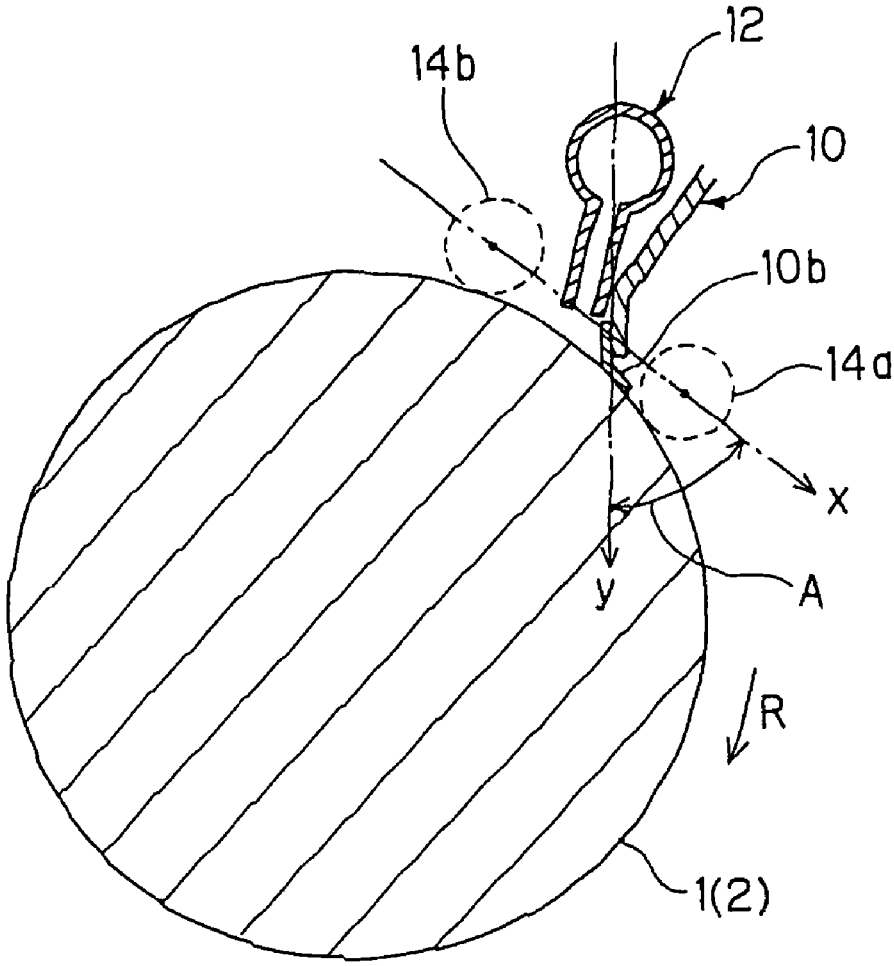
FIG. 5 is a sectional view which shows mutual positional relation of a smoothing means, a supplying and coating means and a following means used in one embodiment of the apparatus for coating the outer peripheral surface of a pillar structure according to the present invention.

It is preferred that as shown in FIG. 5, angle A formed by a straight line passing the center of the following roller 14*a* and that the following roller 14*b* and the tip portion of the smoothing means 10 (elastic body 10*b*) is 20-60°. If the angle A is smaller than 20°, the force to remove excess coating material becomes smaller and the coating may become larger than the desired size, and if it is greater than 60°, the outer peripheral surface of the pillar structure is strongly pressed and the coating material may be scraped in an amount more than needed. Here, the angle A is an angle formed by "direction x" of a straight line passing the center of the following roller 14*a* and that the following roller 14*b* which directs to the rotation direction R of the pillar structure 1 and "direction y" of an extension line extending from the tip portion (elastic body 10*b*) of the smoothing means 10 toward the pillar structure 1.

The material of the elastic body 10*b* used in this embodiment is not particularly limited so long as when the elastic body 10*b* contacts with the pillar structure 1, it deforms with bending along the outer peripheral surface 1*a* without damaging the outer peripheral surface 1*a* and it can smooth the coat of the coating material, and, for example, there may be preferably used synthetic rubbers such as isoprene rubber, butadiene rubber, styrene-butadiene rubber, chloroprene rubber, urethane rubber and silicone rubber; natural rubbers; elastomers such as polyisobutylene and polyethylene; foamed materials such as foamed polyurethane, foamed polystyrene, foamed polyethylene, foamed polypropylene and sponge. Moreover, there may be used resins such as fluororesins, polyimide resins, polyamides and polyphenylene oxide.

Furthermore, the elastic body 10*b* is in the form of a sheet, and the width thereof is preferably 1-10 mm. If it is less than 1 mm, the elastic body 10*b* cannot sometimes cope with the change in clearance (distance) between the elastic body and the outer peripheral surface of the pillar structure, and if it is more than 10 mm, the coating material is scraped too much, resulting in considerable partial uncoating at the time of coating. The thickness of the elastic body 10*b* is preferably 1-5 mm. If it is less than 1 mm, the elastic body sometimes deforms too much, and the coating surface of the coating material cannot be sufficiently smoothed, and if it is more than 5 mm, the elastic body hardly deforms and hence it strongly presses the coating surface of the coating material and scrapes the coating material in an amount more than needed. The hardness of the elastic body 10*b* is preferably 30-80. If it is less than 30, the elastic body deforms too much and the coating surface of the coating material cannot sometimes be sufficiently smoothed, and if it is more than 80, the elastic body hardly deforms and hence it strongly presses the coating surface of the coating material and sometimes scrapes the coating material in an amount more than needed.

Here, the width of the elastic body 10*b* means the distance w (width of the elastic body) from the longer side end of the smoothing plate 10*a* at which is provided the elastic body 10*b* to the longer side end of the elastic body 10*b* on the side of the pillar structure as shown in FIG. 2, and the thickness of the elastic body is the thickness d (thickness of the elastic body) of the sheet which forms the elastic body as shown in FIG. 2. The hardness of the elastic body means the international rubber hardness (IRHD) measured in accordance with "test method on hardness of vulcanized rubber and thermoplastic rubber" of JIS K6253.

The material of the cam 2, pedestal 3 and smoothing plate 10 is not particularly limited, and it is preferred that the outer surface thereof is stainless steel or wear-resistant ceramics. The wear-resistant ceramics are preferably $Si_3N_4$, PZT, SiC or $Al_2O_3$.

The apparatus 50 for coating the outer peripheral surface of a pillar structure of this embodiment (see FIG. 1) can be applied preferably to coating of the outer peripheral surface of the pillar structure 1 of which the section cut along a plane perpendicular to the central axis is circle or ellipse, and it can also be preferably applied to coating of the pillar structure having the shape of section other than circle or ellipse and having an outer peripheral surface comprising a smooth curved surface.

The apparatus 50 for coating the outer peripheral surface of a pillar structure of this embodiment (see FIG. 1) can be preferably applied to coating of the pillar structure 1 which is a honeycomb structure comprising a plurality of cells which serve as flow paths of fluid. Suitable examples of the material of the honeycomb structure are ceramics. Furthermore, it can also be preferably applied in case when the honeycomb structure is held by the holding means 4, the central axis slightly deviates (slants) from vertical direction.

The coating materials used in using the apparatus for coating the outer peripheral surface of a pillar structure of this embodiment are not particularly limited so long as they are suitable for coating the outer peripheral surface of the pillar structure, and there may be used, for example, paste-like coating materials containing inorganic fibers, inorganic binders, inorganic particles, organic binders, or the like. The inorganic fibers include, for example, ceramic fibers such as silica alumina, mullite, alumina and silica. The inorganic binders include, for example, silica sol, alumina sol and the like. The inorganic particles include, for example, powdered silicon carbide, powdered silicon nitride, powdered boron nitride, and whiskers. The organic binders include, for example, polyvinyl alcohol, methylcellulose, ethylcellulose and carboxycellulose. Furthermore, the coating materials contain solvents such as water, acetone and alcohol, in addition to the inorganic fibers, inorganic binders, inorganic particles, organic binders, etc. The viscosity of the paste-like coating materials is adjusted by these solvents to give the state suitable for coating on the outer peripheral surface of the pillar structure. The viscosity of the coating material is preferably 15-50 Pa·s. If the viscosity is lower than 15 Pa·s, the thickness of the coating sometimes becomes too thin because of the low viscosity, and if it is higher than 50 Pa·s, it becomes difficult to coat thinly and uniformly on the outer peripheral surface because of the high viscosity.

In another embodiment of the apparatus for coating the outer peripheral surface of a pillar structure according to the present invention, the holding means 4 has the pedestal 3, but does not have the cam 2. The pillar structure 1 is placed on the pedestal 3 in such a manner that its central axis nearly coincides with the central axis of the pedestal 3, the elastic body 10*b* of the smoothing means 10 is disposed so that it contacts with the outer peripheral surface 1*a* of the pillar structure 1, and the coating surface of the coating material supplied from the nozzle 12 of the supplying and coating means 12 and coated on the outer peripheral surface of the pillar structure 1 is smoothed between the outer peripheral surface 1*a* and the elastic body 10*b*. In this case, the following rollers 14 used as a following means are two rollers of the third following roller 14*c* and the fourth following roller 14*d* which copy the outer periphery of the pedestal 3 since the holding means 4 does not have the cam 2.

This embodiment is the same as the embodiment shown in FIG. 1, except that the holding means 4 has the pedestal 3, but does not have the cam 2 and the following means 14 comprises the two rollers of the third following roller 14*c* and the fourth following roller 14*d* which copy the outer periphery of the pedestal 3.

In further another embodiment of the apparatus for coating the outer peripheral surface of a pillar structure according to the present invention, the supplying and coating means 12 and the smoothing means 10 rotate together along the outer peripheral surface 1*a* of the pillar structure 1. In this case, the coating material is supplied from the supplying and coating means 12 and coated, and the coating surface is smoothed by the smoothing means 10 while the supplying and coating means 12, the smoothing means 10 and the following means 14 rotate together along the outer peripheral surface 1*a* of the pillar structure 1 on the central axis of the pillar structure 1 as a rotation center.

This embodiment is the same as the embodiment shown in FIG. 1, except that the supplying and coating means 12, the smoothing means 10 and the following means 14 rotate together along the outer peripheral surface 1*a* of the pillar structure 1 as a rotation center.

Next, the method for coating the outer peripheral surface of a pillar structure according to the present invention will be explained specifically referring to the drawings. The method for coating the outer peripheral surface of a pillar structure is characterized in that using the apparatus 50 for coating the outer peripheral surface of a pillar structure described above (see FIG. 1), the pillar structure 1 is held by the holding means 4, and while rotating the pillar structure 1 on an axis of nearly vertical direction as a common rotating axis, a coating material is supplied from the supplying and coating means 12 onto the outer peripheral surface 1*a* of the pillar structure 1 and is coated on the outer peripheral surface 1*a*, and the coating surface of the supplied and coated coating material is smoothed between the outer peripheral surface 1*a* and the elastic body 10*b* (the coating surface is smoothed by the elastic body 10*b*).

In this embodiment, first, the pillar structure 1 is placed on the transferring pallet 30 shown in FIG. 1 and FIG. 6, and the transferring pallet 30 is moved to the space above the pedestal 3. Thereafter, the push-up plate 42 which can elevate and is provided at the central portion of the pedestal 3 (see FIG. 6) is elevated to place the pillar structure 1 thereon, and after the transferring pallet 30 is moved to the original position, the push-up plate 42 is lowered and allowed to stay in the pedestal 3 (namely, the upper surface of the pedestal 3 and the upper surface of the push-up plate 42 are positioned at the same plane), thereby disposing the pillar structure 1 on the pedestal 3, and by using the centering plates 21, 21 shown in FIG. 1 and FIG. 6, the pillar structure 1 is positioned so that the central axis thereof nearly coincides with the central axis of the cam 2 and that of the pedestal 3.

The upper end of the pillar structure 1 placed on the pedestal 3 is allowed to contact with the cam 2 by elevating the pedestal 3, and the pillar structure 1 is interposed between the cam 2 and the pedestal 3 (the cam 2 is positioned on the side of the upper end of the pillar structure 1). Thus, the pillar structure 1 is in the state of being held by the holding means 4.

Next, a slurry-like coating material is fed to a tank 41 shown in FIG. 6. The supplying and coating means 12, the smoothing means 10 and the following means 14 are moved so that the elastic body 10*b* of the smoothing means 10 contacts with the outer peripheral surface 1*a* of the pillar structure 1 and the following means 14 contacts with the outer peripheral surface of the cam 2 as shown in FIG. 3 (namely, transfer the state of FIG. 1 to the state of FIG. 3). In this case, the upper end portion of the elastic body 10*b* is allowed to contact with the outer peripheral surface of the cam 2 and the lower end portion of the elastic body 10*b* is allowed to contact with the outer peripheral surface of the pedestal 3, thereby to inhibit omission of coating at the upper end 1*c* and the lower end 1*b* of the outer peripheral surface 1*a* of the pillar structure 1 (to inhibit occurrence of uncoated portions). Then, a motor 5 for the cam and a motor 6 for the pedestal are started to rotate the cam 2, the pedestal 3 and the pillar structure 1 at a given number of rotation. In this state, the coating material is sent to a supply pipe 12*a* through a piping 13 by a coating material supplying pump (not shown) and is supplied to the outer peripheral surface 1*a* of the pillar structure 1 from the opening of the nozzle 12*b* and coated on the outer peripheral surface 1*a*. The coating surface of the coating material coated on the outer peripheral surface 1*a* of the pillar structure 1 is smoothed by the elastic body 10*b* of the smoothing means 10 to complete the coating of the outer peripheral surface 1*a* of the pillar structure 1.

After completion of the coating of the outer peripheral surface 1*a* of the pillar structure 1, rotation of the cam 2 and the pedestal 3 is stopped and the pedestal 3 is lowered. Thereafter, the pillar structure 1 is pushed up by the push-up plate 42 (see FIG. 6) to raise the end face 1*b* of the pillar structure 1 and the transferring pallet 30 is moved to the lower part of the end face 1*b*. Then, the push-up plate 42 is lowered and the pillar structure 1 is put on the transferring pallet 30 and transferred onto a drying machine stand (not shown), at which the coating material which has been supplied by the supplying and coating means 12 and now has become surplus is recovered by a slurry receiver 40 and recovered into the tank 41 (see FIG. 6) by a pump (not shown).

As mentioned above, since the outer peripheral surface 1*a* of the pillar structure 1 is coated using the apparatus for coating the outer peripheral surface of a pillar structure according to the present invention, the coating surface of the coating material supplied from the nozzle 12*b* of the supplying and coating means 12 and coated on the outer peripheral surface 1*a* of the pillar structure 1 is smoothed between the outer peripheral surface 1*a* and the elastic body 10*b* and hence partial uncoating or peeling of the coating is inhibited. Furthermore, since the coating on the outer peripheral surface 1*a* of the pillar structure 1 can be made thin and uniform by smoothing the coating surface of the coating material under contacting of the elastic body 10*b* with the outer peripheral surface 1*a* of the pillar structure 1, the coating portion is inhibited from cracking during drying after coating. When the pillar structure 1 is disposed with being slanted, the elastic body 10*b* can also be allowed to contact with the whole of the outer peripheral surface 1*a* of the pillar structure 1 in the axial direction, and hence partial uncoating or peeling of the coating is inhibited, and, furthermore, since the coating material can be coated thinly and uniformly, the coating portion is inhibited from cracking during drying after coating.

EXAMPLE

The present invention will be explained more specifically by the following examples, which should not be construed as limiting the invention in any manner.

The outer peripheral surface of a pillar structure was coated as shown below using the apparatus for coating the outer peripheral surface of a pillar structure shown in FIG. 1.

(Pillar Structure and Coating Material)

The pillar structure used was a cylindrical honeycomb structure comprising a plurality of cells which are flow paths for fluid. The material of the structure was cordierite, and the outer peripheral surface was subjected to grinding to obtain the structure having an outer diameter of 143 mm and a height of 150 mm in central axis direction with a rib thickness of 0.175 mm and a cell density of 400 cells/(inch)$^2$. The diameter of a section (diameter of circle) perpendicular to the central axis of the cam 2 and the pedestal 3 was nearly the same as the diameter of a section (diameter of circle) perpendicular to the central axis of the honeycomb structure.

The slurry-like coating material used comprised 75% by mass of a coating cement ($SiO_2$: 60.0, $Al_2O_3$: 39.2, $Na_2O$: 0.4, MgO: 0.3 and other inorganic materials: 0.1 with an antifreeze) and 25% by mass of cordierite powder (average particle diameter 2 μm) and had a viscosity of 20 Pa·s.

(Method of Coating on Outer Peripheral Surface of Pillar Structure)

The pillar structure (honeycomb structure) 1 was placed on the transferring pallet 30 shown in FIG. 1 and the transferring pallet 30 was moved to the space above the pedestal 3. Thereafter, the push-up plate 42 which can be elevated and was provided at the central portion of the pedestal 3 (see FIG. 6) was elevated to place thereon the pillar structure (honeycomb structure) 1, and after the transferring pallet 30 was moved to the original position, the push-up plate 42 was lowered to dispose the pillar structure (honeycomb structure) 1 on the pedestal 3. By using the centering plates 21, 21 shown in FIG. 1, the pillar structure (honeycomb structure) 1 was positioned so that the central axis thereof nearly coincided with the central axis of cam 2 and that of pedestal 3.

The upper end of the pillar structure (honeycomb structure) 1 placed on the pedestal 3 was allowed to contact with the cam 2 by elevating the pedestal 3, and the pillar structure (honeycomb structure) 1 was interposed between the cam 2 and the pedestal 3. Thus, the pillar structure (honeycomb structure) 1 was in the state of being held by the holding means 4.

Next, a slurry-like coating material was fed to the tank 41 shown in FIG. 6. The supplying and coating means 12, the smoothing means 10 and the following means 14 were moved so that the elastic body 10*b* of the smoothing means 10 contacted with the outer peripheral surface 1*a* of the pillar structure (honeycomb structure) 1 and the following means 14 contacted with the outer peripheral surface of the cam 2 as shown in FIG. 3 (namely, transfer to the state of FIG. 3 from the state of FIG. 1). In this case, the distance between the end portion of the smoothing plate 10*a* on the side of the pillar structure (honeycomb structure) 1 and the outer peripheral surface 1*a* of the pillar structure (honeycomb structure) 1 was 0.5 mm. As the elastic body 10*b*, a sheet-like rubber (isoprene rubber) was used. Furthermore, the angle A (formed by a straight line passing the center of the following roller 14*a* and that the following roller 14*b* (direction x) and an extension line of the tip portion of the smoothing means 10 (elastic body 10*b*) (direction y)) shown in FIG. 5 was 45°. In this state, the coating material was sent to the supply pipe 12*a* through the piping 13 by a coating material supplying pump (not shown) and was supplied to the outer peripheral surface 1*a* of the pillar structure (honeycomb structure) 1 from the opening of the nozzle 12*b* and coated on the outer peripheral surface 1*a*. The coating surface of the coating material coated on the outer peripheral surface 1*a* of the pillar structure (honeycomb structure) 1 was smoothed by the elastic body 10*b* (rubber) of the smoothing means 10 to complete the coating of the outer peripheral surface 1*a* of the pillar structure (honeycomb structure) 1. In this case, the cam 2 and the pedestal 3 were rotated (on their own axis) three times at the number of rotation of 10 rpm during the supplying and coating, and, thereafter, rotated (on their own axis) one time at 10 rpm.

(Evaluation of the State of External Appearance During Coating)

The state of external appearance of the coating on the outer peripheral surface of the pillar structure (honeycomb structure) 1 was evaluated with changing the width, thickness and hardness of the elastic body of the smoothing means (Examples 1-14) in the method of coating of the outer peripheral surface of the pillar structure mentioned above. The state of external appearance is shown by the results of overall evaluation conducted on both the degree of partial uncoating and the degree of peeling of the coating, and when the total area of the partial uncoating portion and the peeling portion was 10% or less of the outer peripheral surface (area), this result is indicated by "○"; when the total area was more than 10% and 20% or less of the outer peripheral surface (area), this result is indicated by "Δ"; and when the total area was more than 20% of the outer peripheral surface (area), this result is indicated by "X". Here, the term "partial uncoating" means such a state that the coating was thin and the outer peripheral surface of the pillar structure (honeycomb structure) 1 was exposed, and the term "peeling" means such a state that the coating peeled off. The width of the elastic body means the distance w (width) between the longer side end of the smoothing plate 10*a* at which the elastic body 10*b* was provided and the longer side end of the elastic body 10*b* on the side facing the pillar structure 1 in FIG. 2. The thickness of the elastic body means the thickness d of the sheet as the elastic body in FIG. 2. The hardness of the elastic body is measured by a measuring method based on "test method on hardness of vulcanized rubber and thermoplastic rubber" of JIS K6253. The results are shown in Table 1.

For comparison, coating of the outer peripheral surface of the honeycomb structure was carried out by the above-mentioned coating method on the outer peripheral surface of the pillar structure without providing the elastic body at the smoothing means, and the resulting outer peripheral surface was evaluated (Comparative Example 1). The material of the smoothing means was stainless steel, and the distance between the smoothing means and the outer peripheral surface of the pillar structure was 0.9 mm. The results are shown in Table 1.

(Evaluation on Occurrence of Cracking After Drying of Coating)

Evaluation was conducted on the state of cracking after drying the coating on the outer peripheral surface of the pillar structure (honeycomb structure) 1 obtained in Examples 1-14 and Comparative Example 1. Criteria of the results of the evaluation are as follows: when cracks or fissures were not present in the coating, this result is indicated by "○" and when cracks or fissures were present, this result is indicated by "X". The results are shown in Table 1.

(Measurement of Thickness of Coating)

The thickness of the coating on the outer peripheral surface of the pillar structure (honeycomb structure) 1 obtained in Examples 1-14 and Comparative Example 1 was measured. The thickness of the coating here is defined as follows. The diameter of the pillar structure after coating and the diameter of the pillar structure before coating are measured, and the thickness of the coating is defined to be ½ of the value obtained by subtracting the diameter of the pillar structure before coating from the diameter of the pillar structure after coating. The diameter of the pillar structure is the average value of the diameters at both ends and the central portion in the axial direction of the pillar structure. The results are shown in Table 1.

TABLE 1

| | Width of elastic body (mm) | Thickness of elastic body (mm) | Hardness of elastic body | External appearance during coating | Occurrence of cracking after drying of coating | Thickness of coating (mm) |
|---|---|---|---|---|---|---|
| Example 1 | 1 | 3 | 50 | ○ | ○ | 0.3 |
| Example 2 | 2 | 3 | 50 | ○ | ○ | 0.3 |
| Example 3 | 3 | 3 | 50 | ○ | ○ | 0.3 |
| Example 4 | 5 | 3 | 50 | ○ | ○ | 0.3 |

TABLE 1-continued

| | Width of elastic body (mm) | Thickness of elastic body (mm) | Hardness of elastic body | External appearance during coating | Occurrence of cracking after drying of coating | Thickness of coating (mm) |
|---|---|---|---|---|---|---|
| Example 5 | 10 | 3 | 50 | ○ | ○ | 0.3 |
| Example 6 | 15 | 3 | 50 | Δ | ○ | 0.1 |
| Example 7 | 20 | 3 | 50 | Δ | ○ | 0.1 |
| Example 8 | 3 | 1 | 50 | ○ | ○ | 0.3 |
| Example 9 | 3 | 5 | 50 | ○ | ○ | 0.3 |
| Example 10 | 3 | 8 | 50 | Δ | ○ | 0.2 |
| Example 11 | 3 | 10 | 50 | Δ | ○ | 0.1 |
| Example 12 | 3 | 3 | 30 | ○ | ○ | 0.3 |
| Example 13 | 3 | 3 | 80 | ○ | ○ | 0.3 |
| Example 14 | 3 | 3 | 100 | Δ | ○ | 0.1 |
| Comparative Example 1 | — | — | — | X | X | 0.7 |

As shown in Table 1, it can be seen that when a smoothing means having an elastic body (rubber) was used, the thickness of the coating became thinner and the problems such as partial uncoating and peeling of the coating and occurrence of cracking were inhibited as compared with when a smoothing means of stainless steel was used. Moreover, from the fact that the partial uncoating was inhibited in spite of the thin thickness of the coating, it can be seen that the coating was more uniformly performed. Furthermore, the width of the elastic body was preferably 1-10 mm, the thickness of the elastic body was preferably 1-5 mm, and the hardness of the elastic body was preferably 30-80. By using an elastic body meeting these conditions, the outer peripheral surface of the pillar structure (honeycomb structure) can be more thinly and uniformly coated with inhibiting occurrence of partial uncoating, peeling and cracking.

INDUSTRIAL APPLICABILITY

As explained above, according to the apparatus for coating the outer peripheral surface of a pillar structure of the present invention, the smoothing means has a smoothing plate and a sheet-like elastic body, the elastic body is disposed in such a manner that it contacts with the outer peripheral surface of the pillar structure, and the coating surface of a coating material supplied to the outer peripheral surface of the pillar structure from the supplying and coating means and coated on the outer peripheral surface is smoothed between the outer peripheral surface and the elastic body, and, therefore, occurrence of partial uncoating or peeling off of the coating can be inhibited, and, furthermore, since the coating material is thinly and uniformly coated, occurrence of cracks in the coating portion during drying after coating can be inhibited. As a result, a coating on the outer peripheral surface free from defects can be formed. Furthermore, the method for coating the outer peripheral surface of a pillar structure according to the present invention comprises coating a coating material on the outer periphery of the pillar structure and smoothing the coating surface using the apparatus for coating the outer peripheral surface of a pillar structure of the present invention, and hence occurrence of partial uncoating or peeling off of the coating can be inhibited, and furthermore since the coating material is thinly and uniformly coated, occurrence of cracks in the coating portion during drying after coating can be inhibited. As a result, a coating on the outer peripheral surface free from defects can be formed.

The invention claimed is:

1. An apparatus for coating the outer peripheral surface of a pillar structure comprising:

a holder comprising a cam and a pedestal which holds the pillar structure there between in a substantially vertical direction and rotates together with the held pillar structure on an axis of the substantially vertical direction as a common rotating axis, wherein the holder comprising the cam and the pedestal which holds the pillar structure there between with one end thereof facing downward and rotates the pedestal together with the held pillar structure on the axis of the substantially vertical direction as the common rotating axis;

a supplying and coating mechanism which supplies a coating material to the outer peripheral surface of the rotating pillar structure and coats the coating material on the outer peripheral surface;

a plate-like smoother, a longer side end portion of which is disposed at a given position with respect to the outer peripheral surface and which smoothes a coating surface of the coating material supplied to and coated on the peripheral surface; and a following mechanism which drives the smoother following the outer periphery of the pedestal and/or the cam so that the smoother is disposed at a given position with respect to the outer peripheral surface of the pillar structure, wherein the smoother has a smoothing plate and a sheet-like elastic body provided at the longer side end portion of the smoothing plate on a side of the pillar structure, the elastic body is disposed in such a manner that the elastic body moves so as to make an upper end portion of the elastic body contact the outer periphery of the pillar structure, the sheet-like elastic body having a hardness of 30-80 as measured in accordance with JIS K6253, and wherein the coating material is supplied to and coated on the outer peripheral surface through the elastic body, the coating material is delivered by the moved elastic body from a nozzle from the supplying and coating mechanism to the outer peripheral surface of the pillar structure, the coating surface is smoothed between the outer peripheral surface and the elastic body and the sheet-like elastic body has a thickness of 1-5 mm and a width of 1-10 mm.

2. An apparatus for coating the outer peripheral surface of a pillar structure according to claim 1, wherein the smoother is disposed so that a direction along a length of the smoother substantially coincides with a central axis direction of the pillar structure and the elastic body constituting the smoother is disposed so that the elastic body contacts the outer peripheral surface of the pillar structure between both end faces of the pillar structure.

3. An apparatus for coating the outer peripheral surface of a pillar structure according to claim 1, wherein the holder has the cam which is disposed on a side of another end of the pillar structure placed and held on the pedestal and rotates on the axis of the substantially vertical direction as the common rotating axis.

4. An apparatus for coating the outer peripheral surface of a pillar structure according to claim 3, wherein an outer peripheral shape of the pedestal and that of the cam are substantially the same.

5. An apparatus for coating the outer peripheral surface of a pillar structure according to claim 1 which is further provided with a centering mechanism which holds the pillar structure and the pedestal and/or the cam in a given positional relation.

6. An apparatus for coating the outer peripheral surface of a pillar structure according to claim 3, wherein the following mechanism has first and second following rollers which are disposed at a given distance from each other and move backward and forward following the outer periphery of the cam while contacting the outer periphery of the cam together with the supplying and coating mechanism and the smoother, and the first and second following rollers are disposed so that an angle formed by a straight line passing through the centers of the respective rollers and a tip portion of the smoother is a given angle.

7. An apparatus for coating the outer peripheral surface of a pillar structure according to claim 6, wherein the following mechanism further has third and fourth following rollers which move backward and forward following the outer periphery of the pedestal while contacting with the outer periphery of the pedestal together with the supplying and coating mechanism and the smoother and a rotating axis of the third following roller and that of the first following roller are common and a rotating axis of the fourth following roller and that of the second following roller are common.

8. An apparatus for coating the outer peripheral surface of a pillar structure according to claim 1, wherein the elastic body comprises rubber or a sponge material.

9. An apparatus for coating the outer peripheral surface of a pillar structure according to claim 1, wherein the outer periphery of the pedestal and/or the cam comprise stainless or a ceramic material.

10. An apparatus for coating the outer peripheral surface of a pillar structure according to claim 1, wherein the smoothing plate comprises stainless steel or a ceramic material.

11. An apparatus for coating the outer peripheral surface of a pillar structure according to claim 1, wherein the shape of a section of the pillar structure cut along a plane perpendicular to the central axis of the pillar structure is circular or elliptical.

12. An apparatus for coating the outer peripheral surface of a pillar structure according to claim 1, wherein the pillar structure is a honeycomb structure comprising a plurality of cells which are flow paths for fluid.

13. An apparatus for coating the outer peripheral surface of a pillar structure according to claim 1, wherein the supplying and coating mechanism and the smoother can rotate together along the outer periphery of the pillar structure.

14. A method for coating the outer peripheral surface of a pillar structure using an apparatus for coating the outer peripheral surface of a pillar structure as recited in claim 1, wherein the method comprises the steps of holding the pillar structure by the holder, supplying the coating material from the supplying and coating mechanism on the outer peripheral surface of the pillar structure and coating the coating material thereon while rotating the pillar structure and the holder on the axis of the substantially vertical direction as a common rotating axis, and smoothing the coating surface of the supplied and coated coating material between the outer peripheral surface of the pillar structure and the sheet-like elastic body.

15. A method for coating the outer peripheral surface of a pillar structure as recited in claim 1, wherein the following mechanism includes a pair of rollers positioned on substantially the same horizontal plane and pressing against the outer peripheral surface.

* * * * *